US006705031B2

(12) United States Patent
Briscoe et al.

(10) Patent No.: US 6,705,031 B2
(45) Date of Patent: Mar. 16, 2004

(54) DRAGLINE APPARATUS AND BUCKET

(75) Inventors: Terry Lee Briscoe, Portland, OR (US); Charles George Ollinger, Aloha, OR (US); Ermanno Simonutti, Milwaukie, OR (US)

(73) Assignee: Esco Corporation, Portland, OR (US)

( * ) Notice: Subject to any disclaimer, the term of this patent is extended or adjusted under 35 U.S.C. 154(b) by 0 days.

(21) Appl. No.: 10/375,559

(22) Filed: Feb. 26, 2003

(65) Prior Publication Data

US 2003/0126771 A1 Jul. 10, 2003

Related U.S. Application Data

(63) Continuation of application No. 10/236,358, filed on Sep. 5, 2002, now Pat. No. 6,550,163, which is a continuation of application No. 09/713,999, filed on Nov. 15, 2000, now Pat. No. 6,446,366.

(51) Int. Cl.[7] ..... E02F 3/48
(52) U.S. Cl. ..... 37/398
(58) Field of Search ..... 37/341, 394, 396, 37/356, 398, 395

(56) References Cited

U.S. PATENT DOCUMENTS

| | | | |
|---|---|---|---|
| 833,333 | A | 10/1906 | Newman |
| 860,102 | A | 7/1907 | Newman |
| 887,990 | A | 5/1908 | Weeks |
| 945,547 | A | 1/1910 | Jones |
| 976,163 | A | 11/1910 | Glaze |
| 1,093,887 | A | 4/1914 | Shnable |
| 1,095,335 | A | 5/1914 | Little |
| 1,097,029 | A | 5/1914 | King |
| 1,135,928 | A | 4/1915 | Roys |
| 1,159,803 | A | 11/1915 | Sauerman |
| 1,228,554 | A | 6/1917 | Hanot |
| 1,236,691 | A | 8/1917 | Dunlop |
| 1,242,320 | A | 10/1917 | Burkett |
| 1,263,749 | A | 4/1918 | Dierks |
| 1,289,395 | A | 12/1918 | Clutter |
| 1,313,911 | A | 8/1919 | Potter |
| 1,314,700 | A | 9/1919 | Potter |
| 1,370,566 | A | 3/1921 | Thompson |
| 1,406,725 | A | 2/1922 | Crawford |
| 1,589,907 | A | 6/1926 | Smith |
| 1,804,175 | A | 11/1931 | Massey |
| 2,120,444 | A | 6/1938 | Smith |
| 2,152,907 | A | 4/1939 | Miller |
| 2,158,061 | A | 5/1939 | Atkins |
| 2,267,614 | A | 12/1941 | Martinson |
| 2,947,096 | A | 8/1960 | Cummings |
| 2,952,083 | A | 9/1960 | Forkner |
| 4,035,936 | A | 7/1977 | Avara |
| 4,791,738 | A | 12/1988 | Briscoe |
| 5,084,990 | A | 2/1992 | Briscoe |
| 5,992,061 | A | 11/1999 | Fleck |

FOREIGN PATENT DOCUMENTS

| | | |
|---|---|---|
| AU | 38089/78 | 8/1979 |
| AU | A-34502/89 | 6/1988 |
| RU | 972008 | 11/1982 |
| WO | WO 85/04916 | 11/1985 |
| WO | WO 01/32994 A1 | 5/2001 |

OTHER PUBLICATIONS

ESCO, Production Master Dragline Buckets, Aug. 1993.

*Primary Examiner*—Robert E. Pezzuto
(74) *Attorney, Agent, or Firm*—Chernoff, Vilhauer, McClung & Stenzel

(57) ABSTRACT

A dragline apparatus has an independently controlled front hoist line and rear hoist line. The front hoist line is connected to the forward end of the bucket, and the rear hoist line is connected to the rearward end.

33 Claims, 11 Drawing Sheets

DRAGLINE APPARATUS AND BUCKET

CROSS-REFERENCE TO RELATED APPLICATIONS

This is a continuation of application Ser. No. 10/236,358, filed Sep. 5, 2002, now U.S. Pat. No. 6,550,163, which is a continuation of application Ser. No. 09/713,999, filed Nov. 15, 2000, now U.S. Pat. No. 6,446,366.

BACKGROUND OF THE INVENTION

The present invention is directed to a dragline apparatus, and more particularly, to a bucket that may be used in connection with a dragline apparatus having front and rear hoist lines connected to the bucket.

A dragline apparatus employs a series of lines, such as chains or ropes, to advance and control an earthmoving bucket. A typical bucket of the prior art is supported in part by a pair of hoist lines which are attached to opposite side walls of the bucket. An example of a conventional dragline apparatus is shown in FIGS. 4A and 4B. (See, e.g., U.S. Pat. No. 5,992,061.) The hoist lines are, in turn, coupled through a linkage assembly to one or more lift lines which extend down from an overhead boom. A dump line is connected to the front end of the bucket and to a drag line or drag rope (referred to herein as a drag rope) used for pulling the bucket through the ground. A medial portion of the dump line is wrapped about the sheave of a dump block which is also connected through a linkage assembly to the lift lines. The tension applied to the dump line by the drag rope causes the dump line to raise the front of the bucket. Release of the tension then permits the front of the bucket to tip forward and dump the accumulated load.

The production capacity of a dragline apparatus, or the amount of material that may be removed by the dragline apparatus over a given period of time, depends on several factors. One factor is the capacity of the bucket, which in turn depends on the weight of the bucket. It is desirable to decrease the weight of the bucket so as to allow more material to be carried. However, it is often necessary to provide heavy wear protection and to use heavy chains because of the wear and stress encountered by the bucket during operation. Production capacity is also related to the cycle time, which is the amount of time required to fill and empty a bucket. Reducing the cycle time will allow a bucket to carry more material over a given period of time, thus increasing production capacity.

A conventional dragline apparatus has the advantage of requiring only two winches to control movement of the bucket. Hoisting is controlled by a hoist winch, which controls movement of the hoist lines. A second winch is used to control the drag rope. Tension on the drag rope and hoist line is used to control the attitude of the bucket.

Nevertheless, the conventional dragline apparatus has several disadvantages. One of the primary problems with the current dragline apparatus is that there are many places where the bucket cannot be picked up without spilling the contents of the bucket. This is due to the relationship between the drag rope and the hoist line and the included angle therebetween. When the included angle between the drag rope and the hoist line is less than 90°, it is very difficult to pick up the bucket unless an extremely short dump line is used. However, when a very short dump line is used, the tension on the dump line when the bucket is carried can be extremely great such that damage is done to the dump line, dump block, dump block connection hardware, arch, and many other associated rigging components. The inability of the conventional dragline apparatus to pick up the bucket over a wide range of locations limits production capacity.

Buckets must also be built to withstand enormous stresses, but this increases the weight of the bucket. In order to hoist such buckets, tension is maintained on the drag rope while tension is applied to the hoist line. Preferably, the front of the bucket begins to lift first, followed by the entire bucket. This has the preferential effect of capturing the loose material, which is heaped at the front of the bucket, rather than having it slough off the front as the bucket is picked up. Unfortunately, this method of lifting has the negative effect of rotating the heel of the loaded bucket through the material every time it is picked up. Accordingly, the heel portion of the bucket is typically substantially reinforced with wear protection. In addition, the inability to pick up the bucket when the included angle between the drag rope and hoist rope is less than 90° often results in the loaded bucket being dragged up the slope to a point at which the bucket can be hoisted. Accordingly, a substantial amount of wear protection is required for the bucket. This need for substantial wear protection has the effect of decreasing the capacity of the bucket.

A conventional bucket also typically has a heavy, reinforced front arch, which provides the connection point to the dump line. Conventional buckets also use a drag chain interconnecting the bucket with the drag rope. One reason for using a chain is to form a catenary to provide clearance during dumping. Both the reinforced arch and drag chains add additional weight, again reducing production capacity.

Yet another disadvantage of the conventional rigging of a dragline apparatus is the requirement of a dump block and its attendant rigging. This adds additional weight and complexity to the apparatus.

Accordingly, there has been at least one attempt to overcome some of these disadvantages by providing a rigging for a dragline apparatus which provides a separate front hoist line and eliminates the dump block and its rigging. Australian Patent Document No. AU-A-34502/89 discloses a dragline apparatus and method of excavation in which the dump rope is omitted and instead replaced with a front hoist line which is attached to the front end of the excavator bucket.

However, it has been found by the present inventors that a conventional bucket will not perform well with such a modified rigging. FIG. 5A shows calculated loads on the drag rope D, front hoist line F, and rear hoist line R connected to a conventional bucket using such a modified rigging. The loads are calculated for a conventional bucket with side trunnions as shown in FIGS. 4A and 4B, and with the front hoist line connected to the anchor on the arch. The calculation assumes a full bucket load and a 15 degree carry attitude, with the bucket located 20 feet below the level of the tub. The calculation shows several drawbacks of a conventional bucket. First, with a calculated negative load in the front hoist rope, it is unlikely that the bucket could be dumped inside of 150 feet from the tub. Further, it is unlikely the bucket would dump well even further out, as there would be insufficient tension to overcome the friction and inertia of the hoist lines within the boom to effect a clean dumping action. The failure to completely dump the load results in a loss of carrying capacity. The material carried back eliminates part of the bucket capacity that would otherwise be available. This is particularly a problem when dumping wet, sticky material. Second, the calculation shows that the average load in the front and rear hoist ropes is far different. The result will be an increased rate of wear on the rear hoist rope relative to the front hoist rope.

Accordingly, what is desired is a bucket for use with a dragline apparatus having a modified rigging system including a front hoist line and a rear hoist line, in which the bucket provides clean dumping over a wide range of locations, that allows efficient dumping, that conserves energy during dumping, that allows for a reduced cycle time, that increases the amount of material that may be carried by the bucket, and that may be operated in an efficient manner.

BRIEF SUMMARY OF THE INVENTION

The invention overcomes the aforesaid drawbacks by providing a dragline apparatus that enables use of an independently controlled front hoist line and a rear hoist line, a modified bucket for such a dragline apparatus, and a method for operating such a dragline apparatus.

In a first aspect of the invention, a dragline apparatus comprises a housing having a front hoist winch and a front hoist line, a rear hoist winch and a rear hoist line, and a drag winch and a drag rope. The front hoist line and the rear hoist line are supported by a boom extending from the housing. A bucket has side, rear and bottom walls, in which the bottom wall terminates in a forward lip adapted to be equipped with excavating teeth. The bottom wall adjacent to the rear wall is contoured to form a heel. Each of the side walls at the forward end have a connection point for attachment of a drag rope. The front hoist line is connected to the forward end of the bucket. The rear hoist line is connected to the bucket at a location adjacent to the heel, and below the average loaded center of gravity of the bucket.

This aspect of the invention provides a number of advantages. In contrast to a conventional dragline apparatus, in this aspect of the invention the rear connection point for the rear hoist line is moved to the rear of the bucket. In addition, unlike a conventional dragline apparatus, the front hoist line is not connected to the arch, but instead is connected to the forward end of the bucket. This results in a bucket that distributes the load more evenly between the front hoist line and the rear hoist line. The carrying capacity of the bucket is improved, as well as the dumping ability. Equalizing the tension between the front and rear hoist lines also causes the lines to wear at the same rate, thus allowing the same size lines and connectors to be used and decreasing the time and expense associated with changing worn out lines.

In another aspect of the invention, a bucket for use with a dragline apparatus comprises side, rear and bottom walls. The bottom wall terminates in a forward lip adapted to be equipped with excavating teeth. The bottom wall adjacent to the rear wall is contoured to form a heel. Each side wall has at the forward end a connection point for attachment of a drag rope. The bucket has at least one rear connection point for a rear hoist line located adjacent to the heel. Each side wall has at the forward end a respective front connection point for a respective front hoist line. The bucket has a first distance between the front connection point and an average loaded center of gravity, and a second distance between the rear connection point and the average loaded center of gravity, such that the first distance is less than the second distance.

By locating the connection points for the front hoist line and rear hoist line in this manner, the load carried by the front hoist line and rear hoist line is distributed in a fashion that allows dumping over a wider range of locations and that also distributes the load more evenly between the front and rear hoist lines. The bucket achieves improved capacity by reducing the weight of the bucket and associated rigging. In addition, the cycle time may be reduced due to quicker dumping of the bucket, and due to quicker return of the bucket after dumping due to reduced weight of the bucket.

In another aspect of the invention, a method is provided for operating a dragline apparatus. A front hoist line and rear hoist line, and a front hoist winch and a rear hoist winch are provided. A bucket is provided having a body comprising side, rear and bottom walls. The bottom wall terminates in a forward lip adapted to be equipped with excavating teeth. The bottom wall adjacent to the rear wall is contoured to form a heel. Each of the side walls at the forward end has a connection point for attachment of a drag rope. A rear hoist line is provided which is connected to the body at a location adjacent to the heel. A front hoist line is provided which is connected to the body at the forward end of the body. The bucket is operated by independently changing the length of the front hoist line while simultaneously independently changing the length of the rear hoist line.

This aspect of the invention provides the advantage of allowing a wide range of motion for the bucket. By independently operating the front hoist and rear hoist lines, the bucket may be picked straight up, thereby reducing wear at the heel portion of the bucket. The efficiency of dumping may be improved, by simultaneously paying out the front hoist line while pulling in the rear hoist line. This may reduce the cycle time and also reduce the amount of energy expended during the dumping operation. In addition, independent operation of the rear and front hoist lines can allow the bucket to be dumped rearward by use of shortening the front hoist line and lowering the rear hoist line. Alternatively, the bucket may be dumped sideways by selectively changing the lengths of the hoist lines. Independent control of the front hoist and rear hoist lines also makes the bucket more adaptable to different digging conditions, improving chopping, bench cutting, rehandle and short dumping.

In another aspect of the invention, a dragline apparatus comprises a housing having a drag line winch, a front hoist winch, and a rear hoist winch. A boom extending from the housing supports the front hoist line and the rear hoist line, which are connected respectively to the front and rear of an excavator bucket. The drag line is connected to the forward portion of the excavator bucket. A coupling mechanism interconnects the front hoist winch and the rear hoist winch, so that the front hoist winch may be unwound at a rate that is proportional to the rate at which the rear hoist winch is wound.

In yet another aspect of the invention, a dragline apparatus comprises a housing having a drag rope winch, a front hoist winch, and a rear hoist winch. A boom extending from the housing supports the front hoist line and the rear hoist line, which are connected respectively to the front and rear of a bucket. The drag rope is connected to the forward portion of the bucket. The housing has a drive shaft connected to a drive transmission interconnecting the front hoist winch and rear hoist winch. A coupling mechanism is operatively engaged with the drive transmission to control the rotation of the front hoist drum and the rear hoist drum. In one embodiment, the coupling mechanism is a second differential. In an alternative embodiment, the coupling mechanism is a sliding rack.

This aspect of the invention has the advantage of providing a mechanical assembly for control of the two independent hoist ropes. The invention eliminates the need for complicated software to run the dragline apparatus, which may be difficult to service in remote mining locations. In contrast, a mechanical assembly may be serviced by the crew that is present at the mining operation.

The foregoing and other features and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
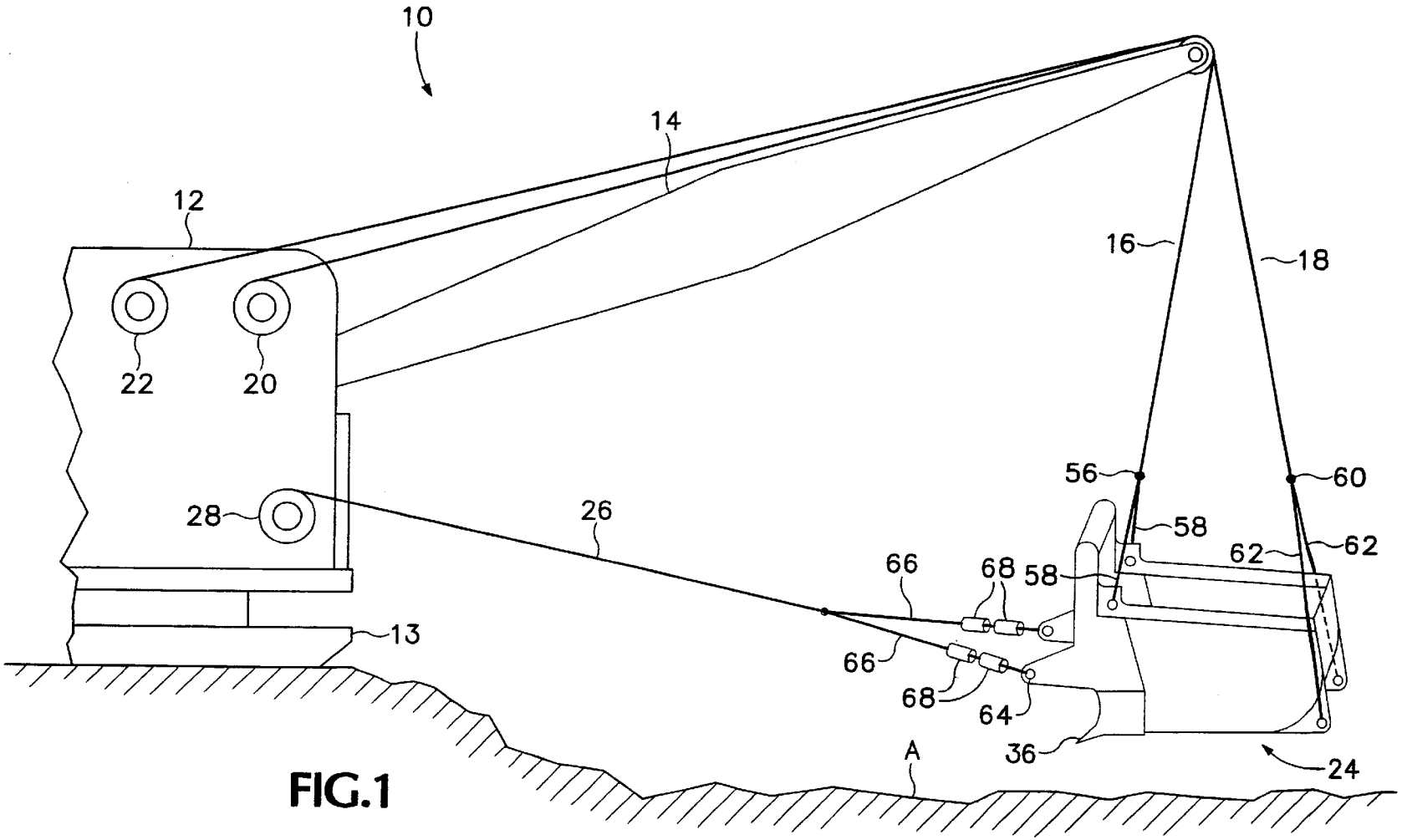
FIG. 1 is a perspective view of a dragline apparatus of the present invention in operation.

Referring now to the figures, wherein like numerals refer to like elements, FIG. 1 shows a perspective view of a dragline apparatus 10 comprised of a prime mover or housing 12 located on a tub 13 above the area to be mined A. Extending away from the housing is a boom 14. The boom supports a front hoist line 16 and a rear hoist line 18. The front hoist line 16 and rear hoist line 18 are connected to respective hoist winches shown schematically in FIG. 1 as 20 and 22. The front hoist line 16 and rear hoist line 18 support the bucket 24. Drag rope 26 is connected to a drag rope winch 28 and to the bucket 24. In operation, the drag rope 26 pulls the bucket 24 across the area to be mined, thereby filling the bucket with material to be removed from the mining area.

The Bucket

Figure 2:
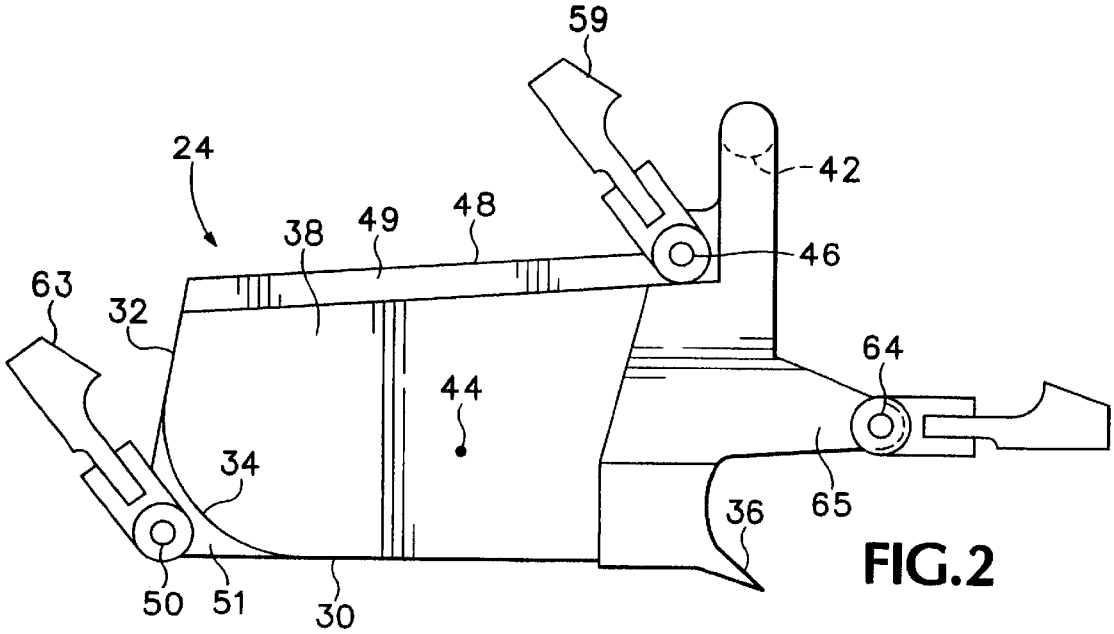
FIG. 2 is a side view of the bucket of FIG. 1.
Figure 3:
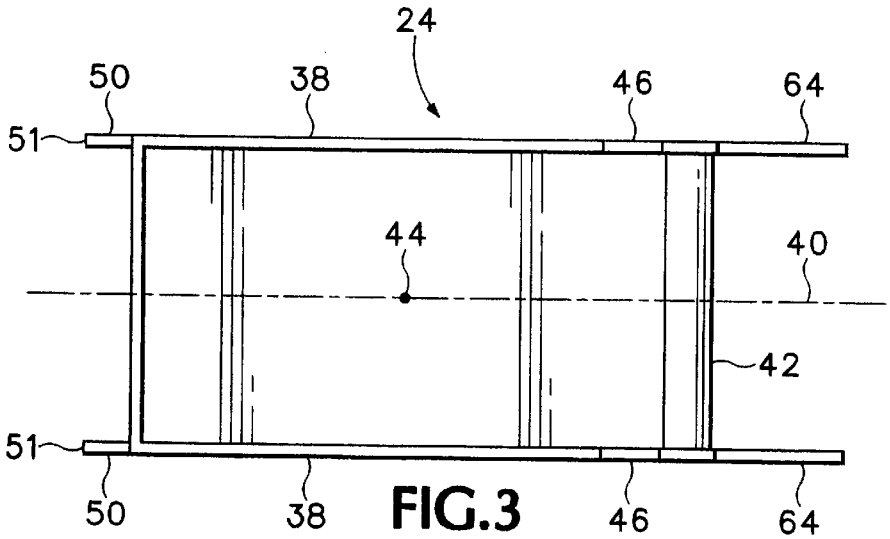
FIG. 3 is a top plan view of a bucket.
Figure 4A:
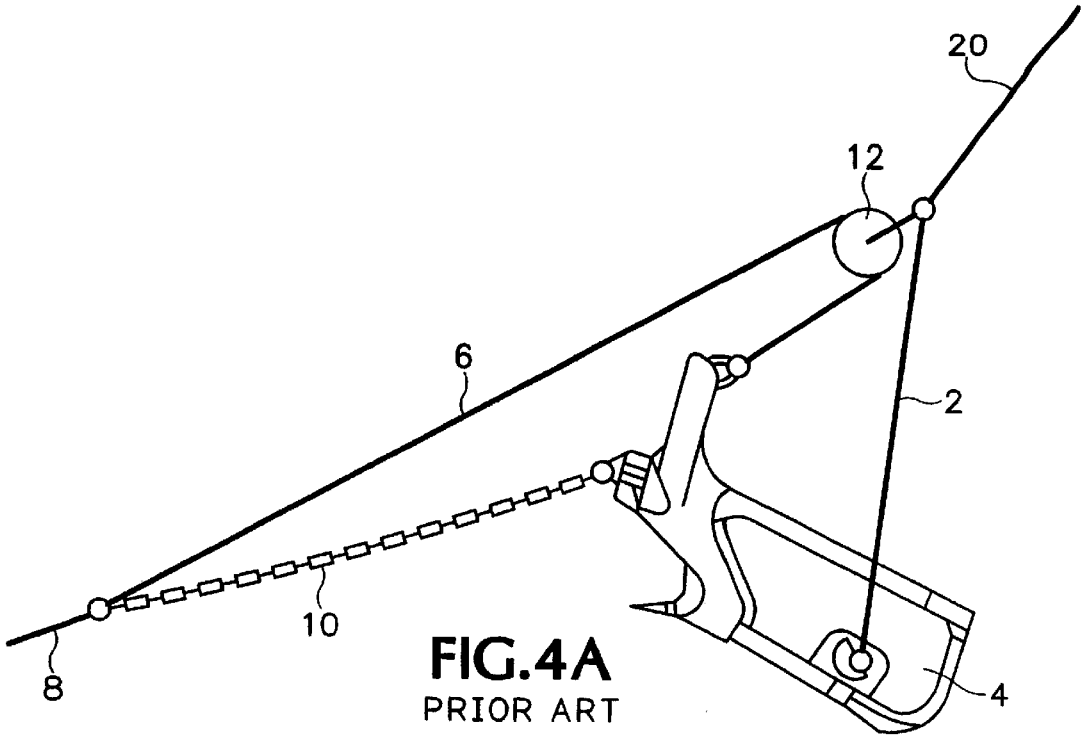
FIG.4A PRIOR ART
FIGS. 4A and 4B show a conventional prior art bucket.
Figure 4B:
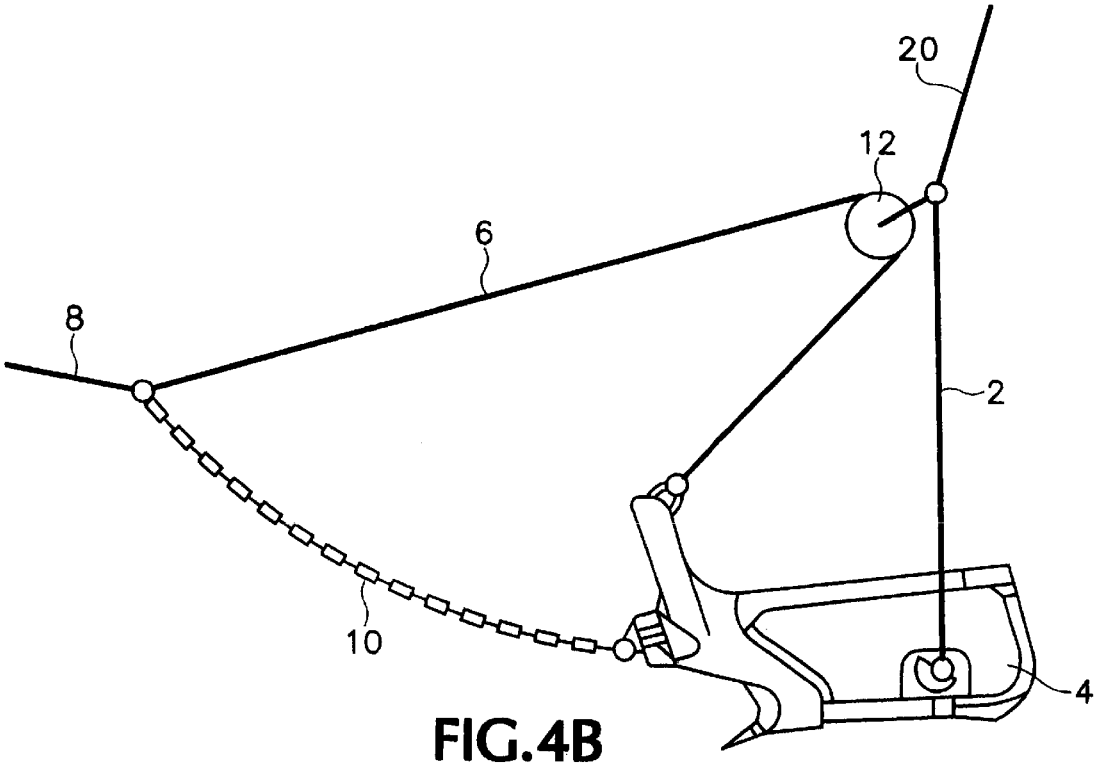
FIG.4B PRIOR ART

Referring now more particularly to FIGS. 2 and 3, the bucket 24 includes a bottom wall 30 merging into a rear wall 32 and providing the heel as at 34. The extreme forward portion of the bottom wall 30 is adapted to be equipped with a plurality of excavating teeth 36. The bucket 24 of the present invention may employ any conventional tooth system, as well as any conventional mechanism for attaching the teeth to the bucket. Exemplary of such systems are shown and described in U.S. Pat. No. 5,709,043, U.S. Pat. No. 5,084,990, and U.S. Pat. No. 5,608,986, the relevant disclosures of which are herein incorporated by reference.

The bucket 24 also includes a pair of upstanding sidewalls 38 with the sidewalls being connected to the bottom wall 30 and the rear wall 32. The bucket 24 is symmetrical about a longitudinal center line 40 (shown in FIG. 3). An optional arch 42 extends between the two sidewalls 38 so as to provide structural support for the two sidewalls. In contrast to conventional buckets, the arch 42 of the present invention may be relatively light weight, and may for example consist of a simple cross-tube. Because the front arch is not used for support, it only needs to be strong enough to maintain alignment of the sidewalls. Alternatively, the arch 42 may be eliminated, thus eliminating additional weight from the bucket.

The front hoist line 16 connects to the bucket 24 at the front hoist connection point 46, which in one embodiment is located at the forward end of the bucket and adjacent to the top edge 48 of the side wall 38. Because the front hoist connection point is located near the top edge 48, the top edge 48 may be reinforced relative to a conventional bucket. In one embodiment, the front connection point is located at the top rail 49.

The rear hoist connection point 50 is located on a bracket 51 attached at the bottom rear of the bucket 24 adjacent to the heel 34. The connection point 50 for the rear hoist line is also below the average loaded center of gravity 44 of the bucket, and more preferably below the empty center of gravity. (By "below" or "above," as used herein, is meant that the connection point is below or above, as the case may be, a horizontal line passing through the center of gravity when the bottom wall 30 of the bucket is horizontal. All designations of relative heights of bucket features or components herein are to be interpreted with the bottom wall 30 of the bucket horizontal.) The foregoing location of the connection point 50 allows the bucket floor to hang past vertical when the bucket is being dumped and held by the rear hoist only. This location below the center of gravity is required for a clean, efficient dumping action. Placing the rear connection point on the trailing bracket 51 provides a further advantage over side-mounted connection points for some digging operations in which the sidewall(s) scrape against material to be mined. While FIG. 3 illustrates a bucket 24 having a pair of brackets 51 providing two rear connection points 50, alternatively the bucket 24 may have only a single bracket 51 providing a single rear connection point 50. This saves additional weight by eliminating the bracket and rigging associated with one of the rear connection points.

The center of gravity of the bucket changes as the bucket is loaded, with the loaded center of gravity being somewhat rearward of the empty center of gravity. The location of the loaded center of gravity is largely a function of the volume of the bucket. The density of the material inside the bucket, although important, does not appreciably change the location of the loaded center of gravity. Accordingly, an average loaded center of gravity may be calculated by calculating the loaded center of gravity using an average density of material of 2800 lbs/yd.

Figure 5A:
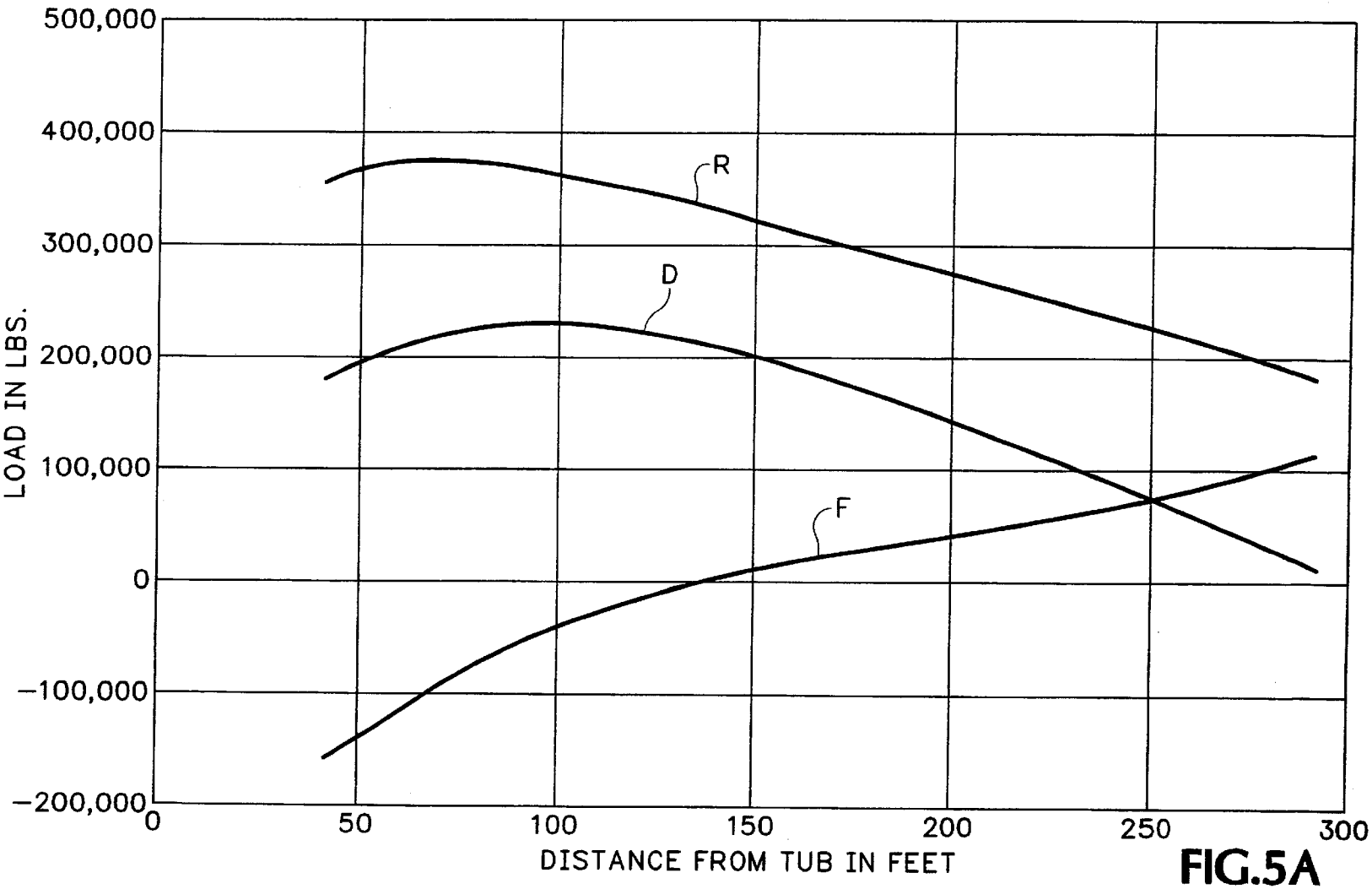
FIG.5A (PRIOR ART)
FIG. 5A is a graph showing calculated loads on the front hoist line, rear hoist line, and drag rope when connected to a conventional bucket.
Figure 5B:
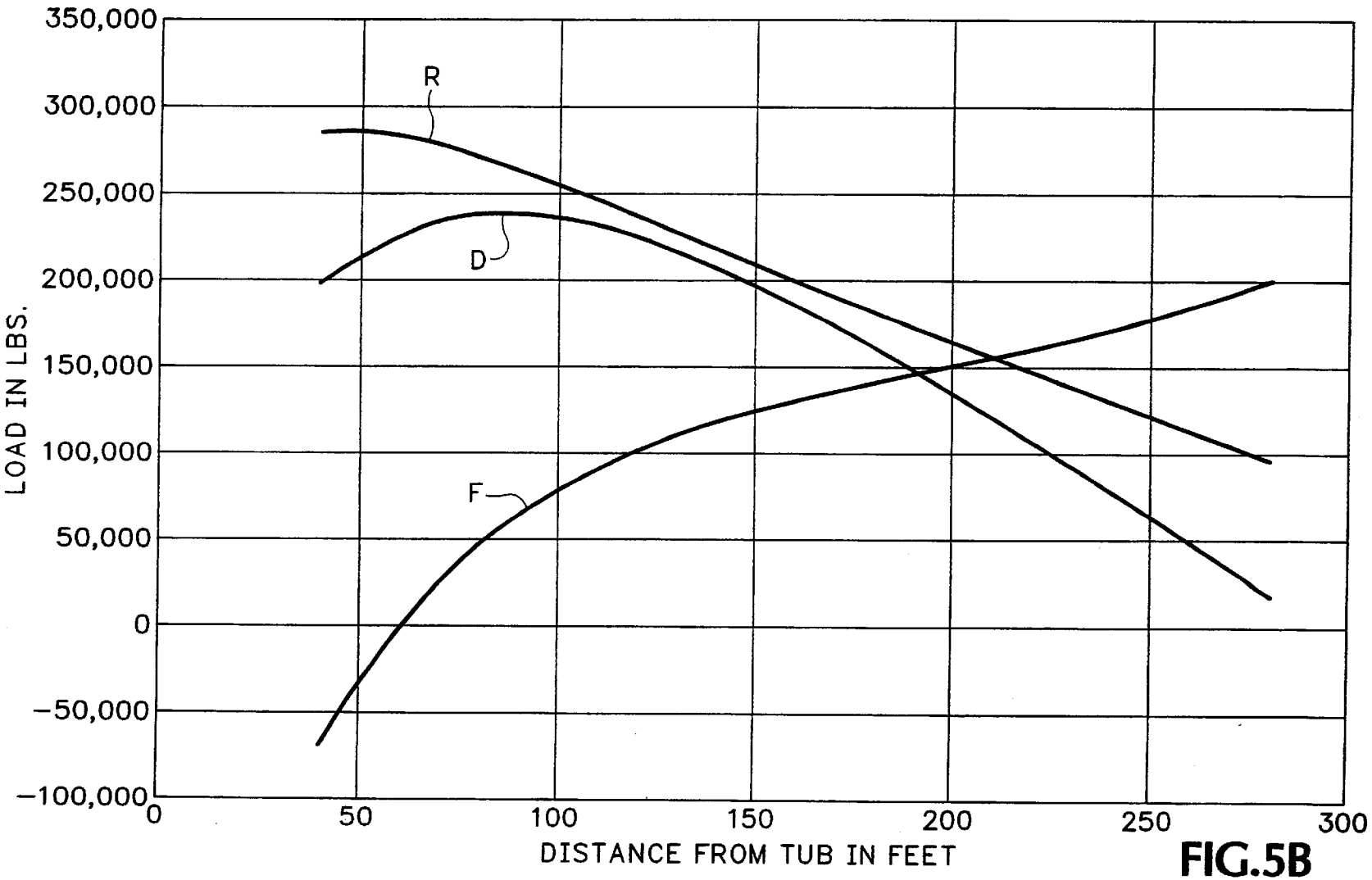
FIG. 5B is a graph showing the calculated loads on the front hoist line, rear hoist line and drag rope when connected to a bucket of the present invention.

Locating the front hoist connection point and rear hoist connection point in these locations provides a number of advantages for the bucket 24 relative to using a conventional bucket. First, moving the rear connection point toward the rear and bottom of the bucket places more load on the front hoist line and serves to better balance the load between the two hoist lines. FIG. 5B illustrates the calculated loads on the front hoist line F, rear hoist line R and drag rope D when connected to the bucket 24. Comparing FIG. 5A (the conventional bucket) with FIG. 5B (the bucket 24 of the present invention) shows that for the bucket 24 of the present invention, the load on the rear hoist line R starts at a much lower value (about 280,000 pounds versus about 370,000 pounds) and decreases to less than 100,000 pounds at 270 feet versus about 200,000 pounds for the conventional bucket. While the load for the front hoist line F of the present invention still is less than 0 close to the tub, the load quickly crosses 0 at 60 feet out (versus about 150 feet for the conventional bucket) and at 100 feet out is about 80,000 pounds of load. In contrast, the conventional bucket load is still less than 0 at the same distance. For the bucket 24, the front hoist and rear hoist loads cross at about 210 feet from the tub, and out at 250 feet, where the bucket would typically be dumped, the load in the front hoist line is much greater: 200,000 pounds versus 100,000 pounds. This should provide a clean dumping bucket that continues to dump even as material is lost from the front of the bucket. Thus, in contrast to the conventional bucket, the bucket 24 connections increase the tension on the front hoist lines and decrease the tension on the rear hoist lines. This improves the carrying ability of the bucket and particularly the dumping ability of the bucket.

The modified bucket 24 also makes the average tension between the front and rear hoist lines more closely equal, which should provide for equal wear on the two lines. This has the advantage of allowing the use of lines having the same size. Where the front and rear hoist lines are of the same size or diameter, the commonality between the two is improved such that the same sockets, wedges, rope, point sheave sizes, etc., may be used for both lines. Second, where the lines are the same size and wear at about the same rate, efficiencies may be realized by changing the lines at the same time. This avoids additional down time or additional changes or expense for changing a non-worn rope.

Moving the front hoist line from the arch down to the top edge provides other advantages. As discussed above, the location places more load on the front hoist line and improves the ability of the bucket to dump at more locations. It also shortens the length of rope that must be unwound from the front hoist winch in order to dump the bucket. It also allows the weight of the arch to be reduced, or even eliminated, since the arch no longer supports the bucket.

Figure 2A:
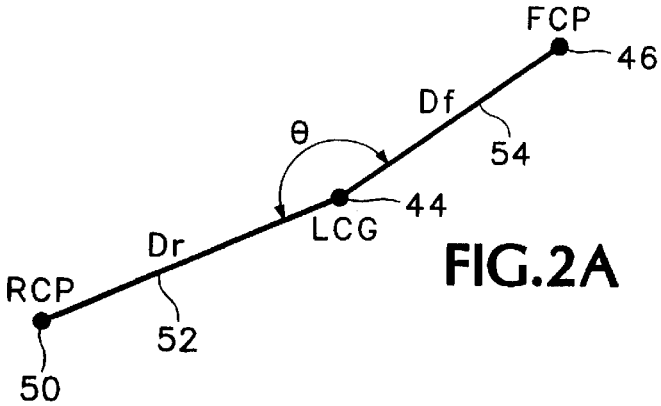
FIG. 2A is a schematic view of the front and rear connection points and the center of gravity of the bucket.

Preferably, the front connection points and rear connection points are located so as to optimize the ability of the bucket to dump cleanly and efficiently. Referring more particularly to FIG. 2*a* which shows schematically the front and rear connection points 46 and 50, line 52 interconnects the rear connection point 50 with the average loaded center of gravity 44, while line 54 interconnects the average loaded center of gravity 44 with the front connection point 46. The two lines 52 and 54 define an included angle 55 therebetween. $D_R$ represents the distance of line 52 while $D_F$ represents the distance of line 54. It is desired that $D_F$ is shorter than $D_R$. It has been found by the inventors that the rear hoist line is generally more loaded than the front hoist line due to tension in the drag rope, and accordingly, shortening the front lever arm, or $D_F$, should increase the load in the front hoist line to thereby equalize the loads between the front hoist and rear hoist lines. In addition, the increased load in the front hoist line should improve the efficiency of the dump and allow the bucket to be dumped over a wider range of locations. Preferably, $D_R$ is from 10% to 30% greater than $D_F$, and preferably is approximately 20% greater than $D_F$.

With respect to the included angle 55, the included angle may vary from 130° to 200°. However, 180° may not be practical based on the design of the bucket and the necessity of mounting the front connection upward on the side of the bucket. The larger the included angle, the greater the interference between the front hoist lines and the front sides and arch of the bucket. However, an included angle of less than 140° has the effect of changing the effective lever arms of one of the hoist lines relative to the other hoist line, and therefore changes the loads in the hoist lines more than would be optimum with a change in bucket attitude. An included angle of approximately 140° to 150° is therefore preferable.

Locating the front hoist connection point and rear hoist connection point so that the difference between $D_R$ and $D_F$ is relatively small (i.e., $D_R$ being up to about 30% greater than $D_F$) means that the center of gravity is approximately midway between the two points. This provides other advantages relating to dumping of the bucket. First, the change in length of rope of the rear hoist and front hoist during dumping is about the same. This approximate matching of the length is beneficial to operation of the dragline to reduce power consumption. In one embodiment discussed below, it is possible to interconnect the drums 20 and 22 so that they turn together during dumping. The drums may be arranged so that if the loads are nearly equal, the power consumption required to rotate the drums may be substantially reduced. In addition, the cycle time may be reduced by allowing the bucket to pivot about a point near the center of gravity of the bucket.

Figure 6:
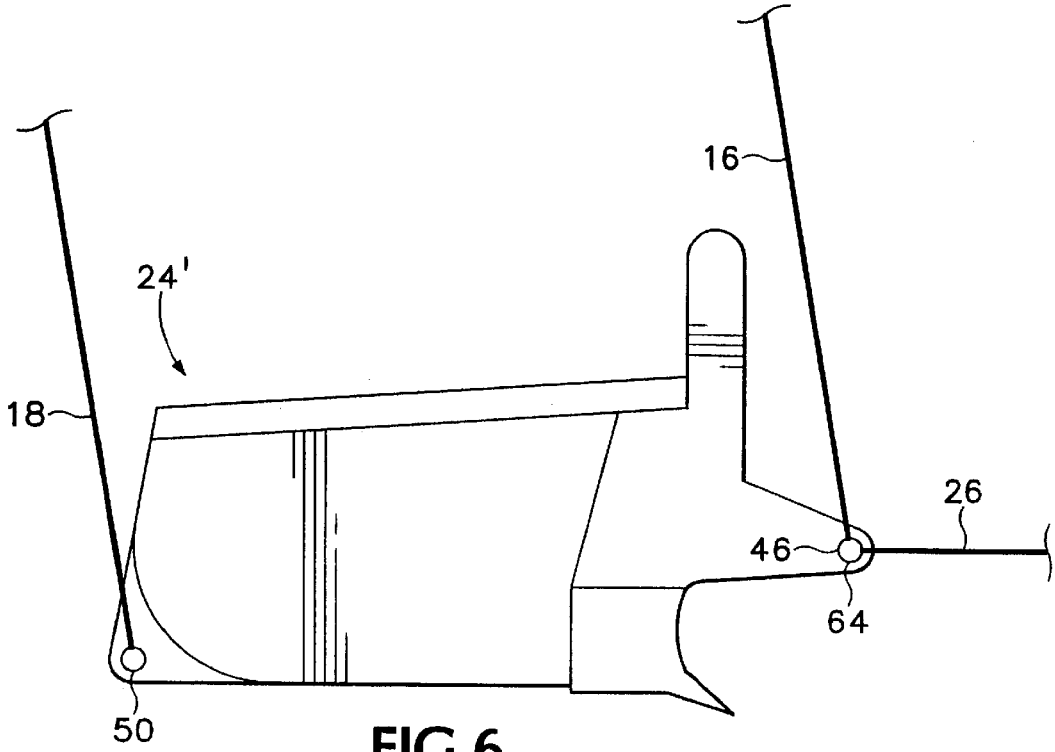
FIG. 6 is a side view of an alternative embodiment of a bucket.
Figure 8E:
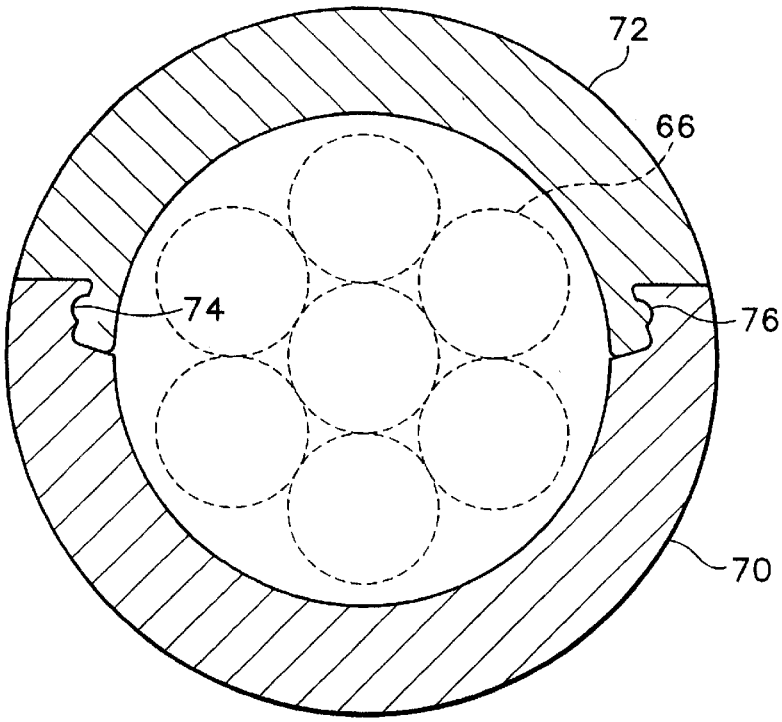
FIGS. 8A–8E are detailed views of a wear protector for the drag rope and/or hoist lines.

In an alternative embodiment of the present invention shown schematically in FIG. 6, the front connection point 46 is moved from the top toward the bottom of the bucket 24'. As shown in FIG. 6, the front connection point 46 is at the same location as the connection point 64 for the drag rope. This has the advantage of simplifying the rigging by providing only four connection points rather than six. Locating the front hoist connection point 46 at the hitch 65 may improve the included angle 55, such that the included angle may be approximately 180°. This would result in loads on the front hoist line and rear hoist line that are equal or nearly equal for all attitudes of the bucket if the line lengths are equal.

Rigging

As discussed above, the bucket 24 of the present invention is used with a dragline apparatus that provides at least one independently controlled front hoist line and one independently controlled rear hoist line. In one embodiment shown in FIG. 1, the dragline apparatus 10 has a single front hoist line 16 and rear hoist line 18. The front hoist line 16 is connected to the bucket 24 by means of a sling 56. Sling 56 may be made from cable, wire rope or chain. In one aspect of the invention, the sling is comprised of a pair of cables 58, each connected to the respective front connection points 46. Connection is made to the front connection point via a wire rope socket 59 or other conventional connector (see FIG. 2). Likewise, the rear hoist line 18 is a wire cable, terminating in a sling 60. The sling is comprised of a pair of wire cables 62 which are also connected to the rear connection points using wire rope socket 63 or other conventional connector (see FIG. 2). This aspect of the invention eliminates the conventional rigging, dump block, and hoist chain of the conventional dragline bucket. Eliminating the dump block reduces the weight of the rigging significantly. It also decreases the length or height of the upper rigging, thereby improving the dump height of the bucket. In addition, eliminating the hoist chains further simplifies the rigging and saves even more weight.

Providing independently controlled front and rear hoist lines yields another advantage in that the amount of wear protection for the bucket may be reduced. During the pickup mode, that is, when the bucket is lifted from the floor of the mining area, the bucket may be lifted nearly straight up. This may be accomplished by lifting the front and rear ends of the bucket by pulling with both the front and rear hoist lines. This contrasts with the method for lifting conventional buckets, which typically involves dragging the bucket forward and pivoting the bucket about its heel. This results in substantial wear at the heel portion of a conventional bucket, thus requiring heavy wear protection. In contrast, because the bucket of the present invention may be lifted straight up, or nearly so, it is no longer necessary to provide the substantial wear protection along the heel. In addition, the present invention allows the bucket to be picked up when it is full, rather than being dragged to a location where it may be lifted, thus further reducing wear on the bucket. Accordingly, the present invention, by reducing the amount of wear protection along the heel and bottom portion (such as lighter bottom wear protection and corner wear shoes), improves the capacity of the bucket.

Figure 7:
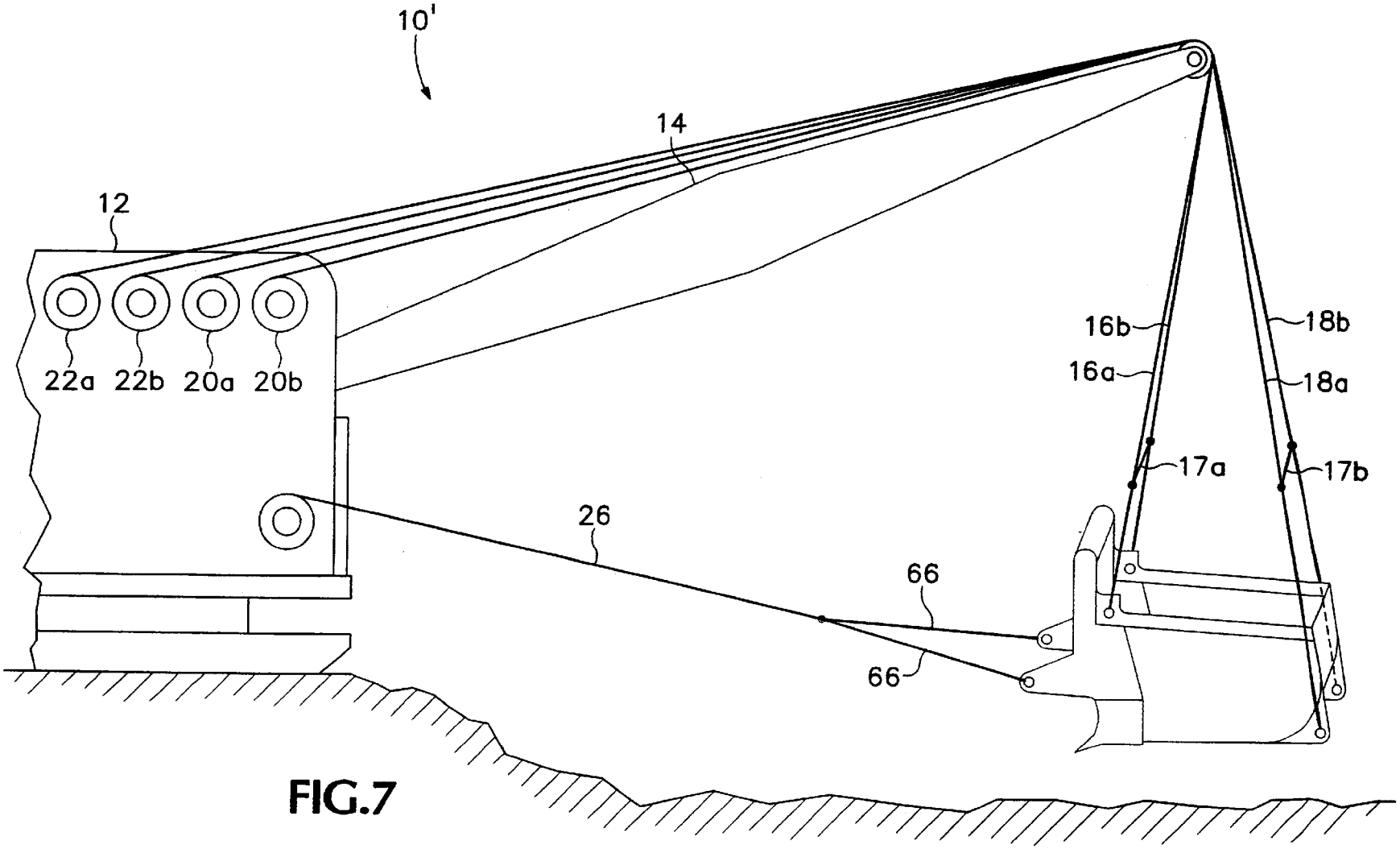
FIG. 7 is a perspective view of an alternative rigging.
Figures 8A, 8B:
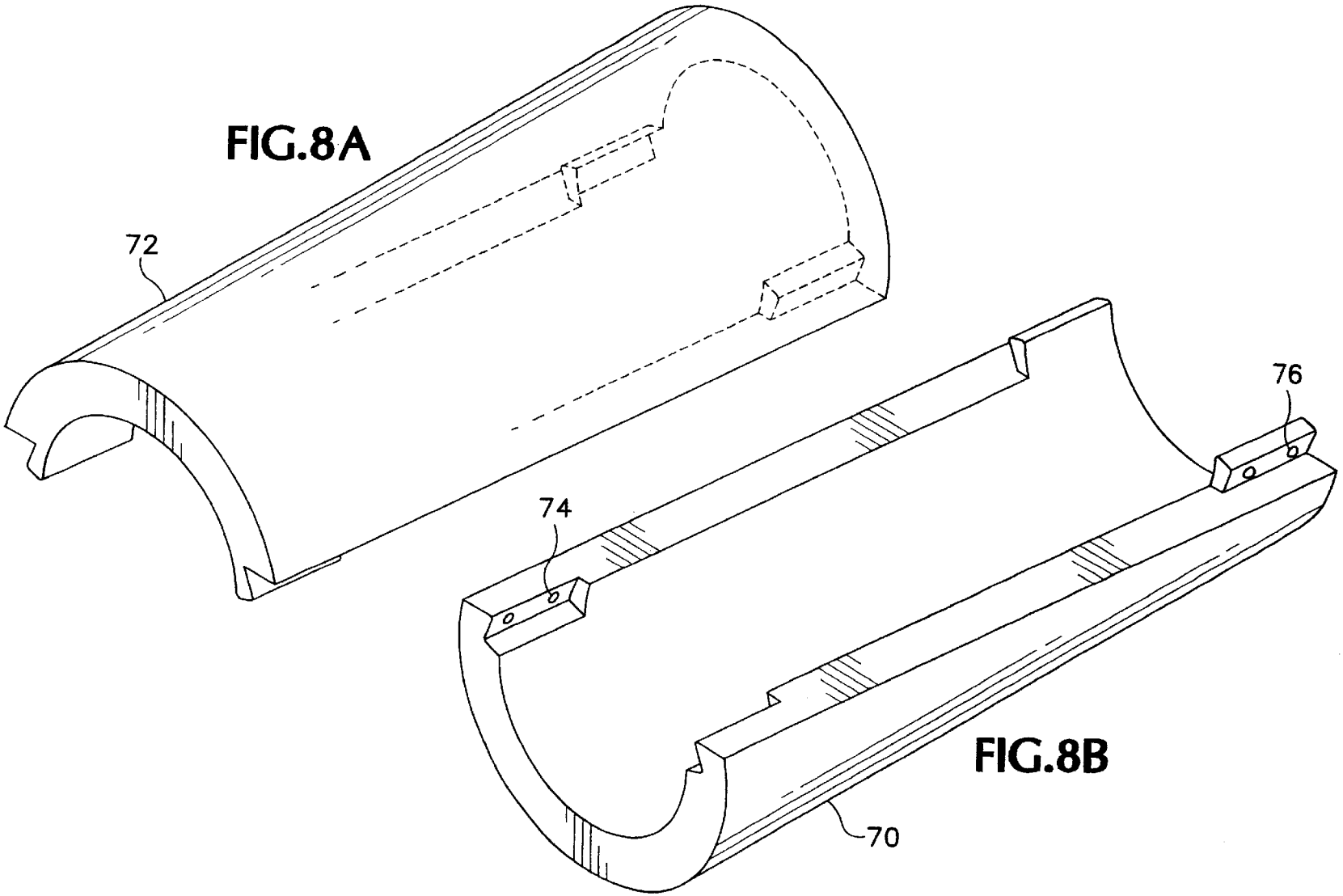
Figures 8C, 8D:
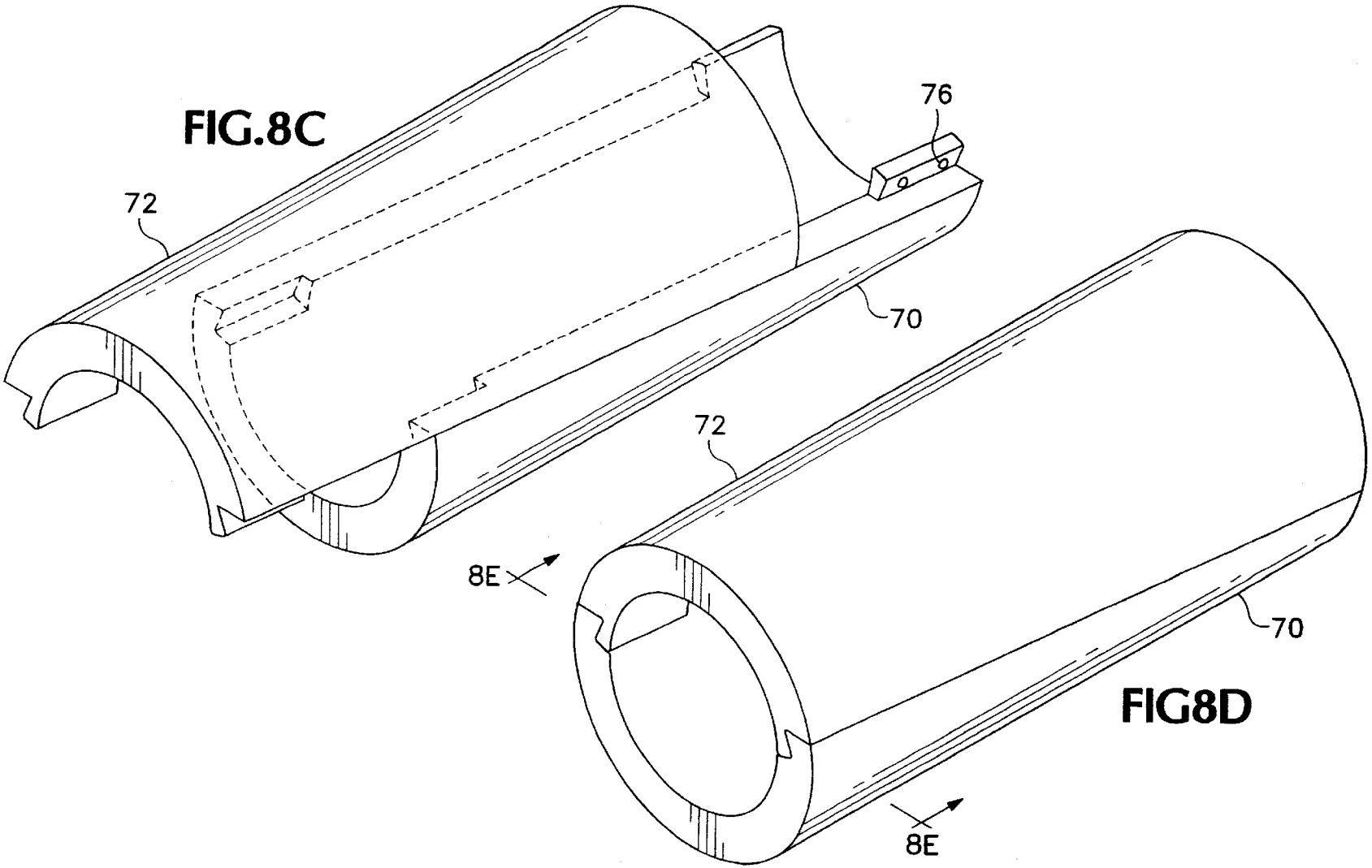

In an alternative embodiment 10 shown in FIG. 7, the dragline assembly may be provided with a pair of front hoist lines 16*a* and 16*b* and a pair of rear hoist lines 18*a* and 18*b*. Each of the pair of front hoist lines and rear hoist lines may be connected to an independently controlled winch, shown as 20*a* and 20*b* for the front hoist lines and 22*a* and 22*b* for the rear hoist lines. Connection of the front and rear hoist lines to the bucket is accomplished in the same manner, except that the sling is omitted. Optional spreader bars 17*a* and 17*b* may be provided. This rigging provides a significant advantage to control and operation of the dragline bucket. Since each of the hoist lines is connected to an independently controlled winch, each hoist line may be independently moved relative to the other hoist lines. Accordingly, the bucket 24 may be tilted side to side, forward or backward, or as otherwise desired. This allows for greater flexibility during the dumping operation. The bucket may be dumped forward, that is conventionally, as described previously. The bucket may also be dumped rearward by shortening the front hoist and lowering the rear hoist lines. The bucket may also be dumped sideways by selectively changing the length of the hoist lines on one side of the bucket, relative to the hoist lines connected to the other side of the bucket. Thus, the bucket may be dumped forward, backward or even sideways depending on the position in the mining area and the requirements of the operation.

In yet another aspect of the invention, the drag rope 26 may include intermediate cable(s) 66 to yield further advantages. Connection of the drag rope 26 is made through an intermediate line of wire rope or cable 66 which is then connected to the hitch 64. The intermediate cable 66 may be replaced as it wears. This contrasts with a conventional dragline apparatus in which the drag rope includes a drag chain, which is then connected to the bucket. In a conventional dragline apparatus using a dump rope, drag chains are required in part to provide a catenary for the front end of the bucket to dump into. The catenary prevents the drag chains from contacting the bucket arch or front end during dumping. However, with the elimination of the dump rope in the present invention, it is no longer necessary to provide a catenary through the use of drag chains. The catenary is no longer required because the forward portion of the drag rope will not be accelerated toward the bucket by the dump rope during dumping. This allows the chains or rope to simply follow the bucket down as it dumps. Accordingly, the replacement of conventional drag chains with an intermediate wire cable saves the weight and expense of the conventional drag chain rigging.

In yet another aspect of the invention, wear protectors 68 are provided for the cables which are connected to the bucket 24. Wear protectors 68 fit around the exterior of the drag rope, and optionally around the rear hoist lines and front hoist lines, respectively. The wear protector 68 may be metal, such as high-hardened steel, or other suitable material that may be placed around the cables to protect them from wear from dirt and debris.

In one aspect of the invention shown in FIGS. 8A–8E, the wear protector 68 is comprised of two interlocking parts 70 and 72. The two interlocking parts may be placed on opposite sides of the wire cable, and then mechanically secured to one another to surround the cable, thereby providing wear protection. As shown in FIGS. 8A–8E, the wear protectors may include mating indentations 74 and protrusions 76 for locking the two halves 70 and 72 together. The two halves 70 and 72 may be identical halves which are split lengthwise along the longitudinal axis of the two halves. An angular cut of from about 5° to 10° from the centerline allows the two halves to be assembled easily on an existing installed line without the necessity of disconnecting the line to install the wear protector. The two halves may be slid together so that the assembly tightens on the installed line. The two halves may then be secured with respect to one another by matingly engaging the protrusion 76 with the indentation 74.

Operation of Hoist Lines

In operation, for the embodiment of FIG. 1, front hoist line 16 and rear hoist line 18 are controlled independently so as to allow raising, lowering, and dumping of the bucket. In one embodiment, the front hoist winch 20 and rear hoist winch 22 are driven by separate drive shafts. The drive shafts may be driven in any conventional manner, such as by electric motors.

Figure 9:
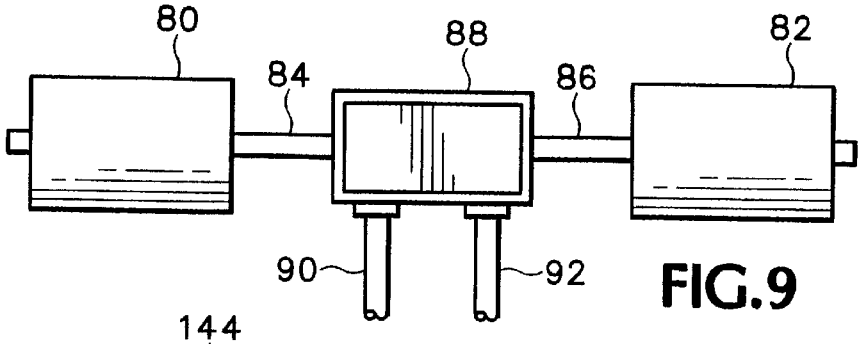
FIG. 9 is a schematic view of a winch assembly having a coupling mechanism.

FIG. 9 shows schematically a winch assembly that may be used with the present invention. The assembly includes front hoist drum 80 and rear hoist drum 82, to which are connected the front hoist lines and rear hoist lines respectively. Front hoist drum 80 is driven by shaft 84, while rear hoist drum 82 is driven by shaft 86. A coupling mechanism 88 interconnects the drums 80 and 82. The coupling mechanism 88 is operatively engageable with input drive shafts 90 and 92. The coupling mechanism 88 allows the front hoist drum 80 and rear hoist drum 82 to be selectively engaged with one another. For example, the front hoist line may be connected to the front hoist drum 80 so that the drum rotates clockwise to retrieve the front hoist line, while the rear hoist drum may be connected to the rear hoist line to rotate counterclockwise to retrieve the rear hoist line. During dumping, the coupling mechanism 88 may be engaged so that the front hoist drum 80 and rear hoist drum 82 are interlocked with one another, and therefore rotate at a proportional rate with respect to one another. This may be accomplished by providing a desired gear ratio within the coupling mechanism 88. By interlocking the front hoist drum 80 and rear hoist drum 82 in this manner, the energy required to dump the bucket may be substantially reduced, since the paying out of the front hoist line will compensate for the energy required to retrieve the rear hoist line.

Examples of coupling mechanism 88 that may be used include a friction clutch, a dual drive transmission (described below) and a posilock differential.

In one embodiment, the rotation of the winches is controlled by a microprocessor. In the dumping mode of operation, the rate at which the front hoist drum and rear hoist drum rotate may be controlled by the microprocessor so as to allow opposite movement of the front hoist and rear hoist lines with respect to each other. The dumping function may be programmed to allow the front hoist line to be paid out and rear hoist line taken in by a certain amount, which would be preset by the operator. The microprocessor could also recover the bucket back to normal attitude or some preset attitude programmed by the operator following dumping.

In the pick up mode of operation, the microprocessor controls the front hoist winch and rear hoist winch to control the attitude of the bucket. In general, it is desired to carry the bucket at an attitude that minimizes the amount of material lost during transit of the bucket. By carry attitude is meant the angle from the true horizontal to the bucket floor. In general, the attitude depends on the type of material being picked up or the moisture content of the material in order to enable the bucket to carry a maximum load. During carrying of the material to the dump site, the front and rear hoist lines will need to shorten by differing amounts to maintain the dragline bucket in the same carry attitude. If the hoist lines stayed the same length relative to one another then as the bucket moved further from the machine, the front of the bucket would tip down relative to the back. Therefore, there must be some minor adjustments as the bucket is carried to the dump site to maintain the bucket at a constant attitude.

In one embodiment, the bucket is maintained at a relatively constant attitude by providing a sensing device which measures the lengths of the hoist lines from a given point, for example the boom point sheaves for the hoist ropes and the fairlead sheaves for the drag rope. The microprocessor is initialized, for example at the beginning of an operator shift, to determine the position of the lines relative to the sensing device. During operation, the sensing device measures the change in the hoist line lengths, and the location of the end of the hoist lines may then be calculated using software. The operator may set an input for the desired attitude of the bucket, and the microprocessor may adjust the hoist line lengths to maintain that attitude during the pickup and carry.

In another embodiment, the bucket may be provided with an on board sensor which transmits a signal to the microprocessor representative of the bucket attitude. The microprocessor may then adjust the hoist lengths in response to the signal transmitted by the sensor.

In yet another embodiment, a mechanical drive transmission is used to control operation of the front and rear hoist drums without the use of a microprocessor. In one embodiment shown in FIG. 10 the drive transmission 100 is comprised of a dual differential housing having two different input drives. The dual differential housing has a first conventional differential 110. Conventional differential 110 is driven by main input drive shaft 104, which terminates in a drive pinion 112. Drive pinion 112 drives a conventional ring gear 114. Pinion gears 116*a* and 116*b* are mounted to a housing (not shown) which is connected to the ring gear 114. Side gears 118*a* and 118*b* intermesh with pinion gears 116*a* and 116*b*. Side gear 118*a* is connected to axle 120, which drives the front hoist drum (not shown). Likewise, side gear 118*b* is connected to axle 122, which drives the rear hoist drum (not shown). Mounted on axles 120 and 122 are idler wheels 124 and 126.

The drive transmission has a second differential 130 driven by drive shaft 106, which terminates in a drive pinion 132. Drive pinion 132 drives a conventional ring gear 134. Pinion gears 136*a* and 136*b* are mounted to another housing (not shown) which is connected to the ring gear 134. Side gears 138*a* and 138*b* intermesh with pinion gears 136*a* and 136*b*. Side gear 138*a* is connected to axle 140, to which is mounted idler wheel 144. Likewise side gear 138*b* is connected to axle 142, to which is mounted idler wheel 146. Secondary idler wheel 150 is mounted between idler wheel 144 and 124.

In operation, the main drive shaft 104 turns the front hoist drum and rear hoist drum at the same speed, so as to run the two hoist lines in and out at the same speed. The alternate drive shaft 106 controls counter rotation of the drums, and hence movement of the hoist lines opposite to one another. By controlling the main drive shaft 104 and the alternate drive shaft 106, the direction and rate of rotation of the front hoist drum and rear hoist drum may be controlled independently of one another.

For example, if it is desired to rotate the front and rear hoist drums in the same direction and at the same speed so as to raise the bucket at a substantially uniform rate for both the front and back ends, then the drive shaft 106 may be locked so that it cannot turn. The two wheels 144 and 146 connected to this drive shaft are then forced by way of the second differential 130 to counter rotate at the same speed. The second idler wheel 150 reverses the direction of rotation between the wheels 144 and 124. The net result is to force the axles 120 and 122 to rotate in the same direction and at the same speed. Accordingly, as will now be appreciated, the direction of rotation of each of the axles 120 and 122 and the speed at which each rotates may be varied as desired by controlling the two input shafts 104 and 106.

Figure 10:
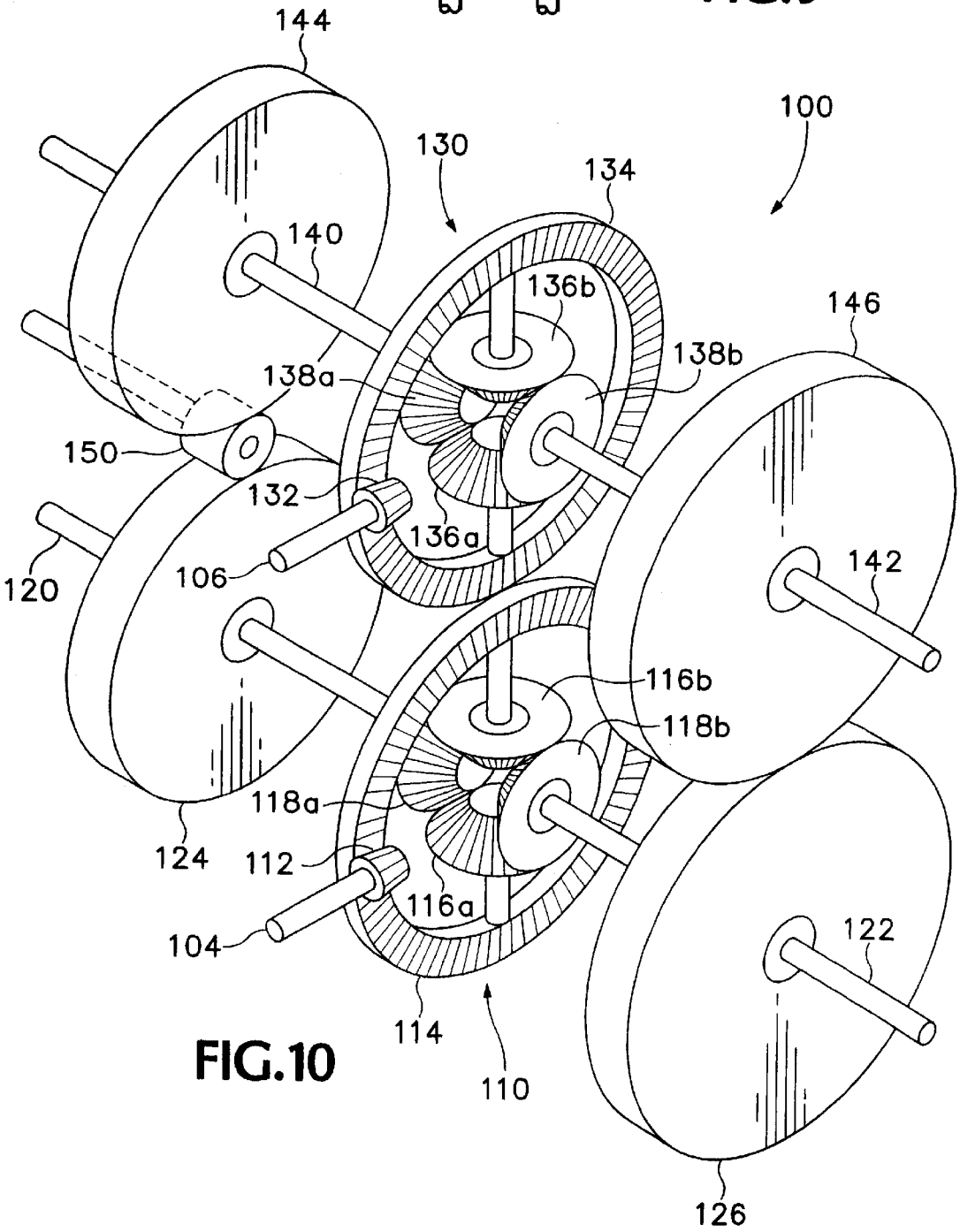
FIG. 10 is a perspective view of a drive transmission.
Figure 11:
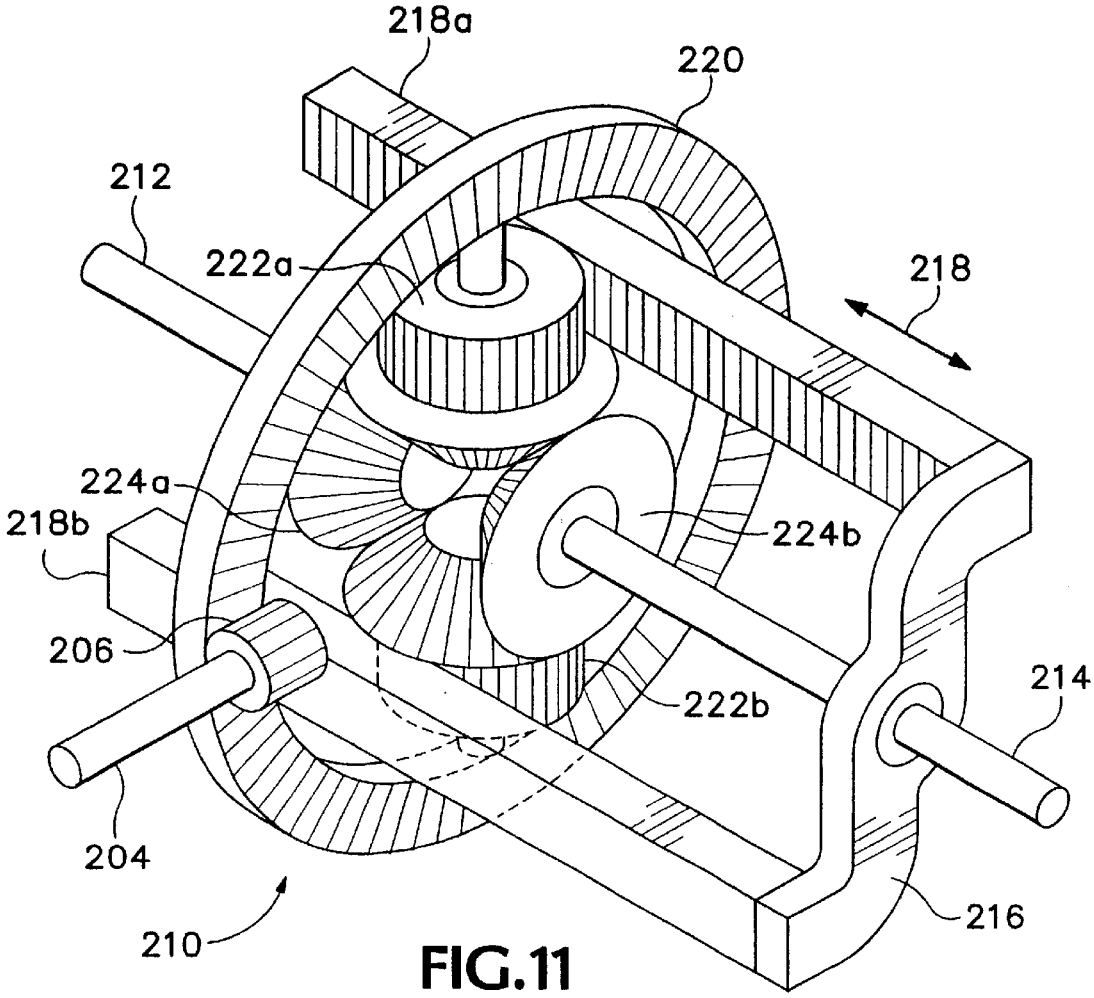
FIG. 11 is a perspective view of an alternative drive transmission.

Yet another alternative mechanical drive transmission 200 for controlling the front and rear hoist drums is shown in FIG. 11. Like the embodiment of FIG. 10, a differential 210 is driven by a main drive shaft 204. Drive shaft 204 terminates in a drive pinion 206, which drives ring gear 220. Gears 222*a* and 222*b*, which each include a bevel gear portion and a pinion gear portion, are suspended inside a carrier housing (not shown), to which ring gear 220 is mounted. The bevel gear portions of 222*a* and 222*b* intermesh with bevel gears 224*a* and 224*b*, which are mounted on output shafts 212 and 214. Shaft 212 drives the front hoist drum (not shown), and shaft 214 drives the rear hoist drum. The pinion portions of gears 222*a* and 222*b* mesh with racks 218*a* and 218*b*, which slide in guides contained in the carrier housing. The racks 218*a* and 218*b* are connected to a common structure, namely rack support 216, so as to move back and forth as shown by arrow 219. Support 216 therefore rotates with the carrier housing, but slides back and forth parallel to shafts 212 and 214, and is driven by a linear actuator, such as another rack and pinion, or the like, preferably through an anti-rotation bearing.

In operation, main drive shaft 204 turns both the front hoist drum and the rear hoist drum in the same direction. While rack support 216 is prevented from sliding, gears 222*a* and 222*b* cannot rotate on their pins, and both shafts 212 and 214 will turn at the same speed. When rack support 216 is made to slide from one side toward the other, gears 222*a* and 222*b* will rotate on their pins, which will cause bevel gears 224*a* and 224*b* to rotate relative to the carrier housing, in directions opposite each other. This will drive the hoist drums to turn in opposite directions, or if main drive shaft 204 is also turning, the hoist drums will turn at different speeds. Sliding the rack support 216 from one end of its travel to the other will result in a fixed difference in payout of the front and rear hoist ropes. Therefore, the drive mechanism must be designed to provide sufficient rope payout differential to fully dump the dragline bucket.

To control either the two drive shafts in the embodiment of FIG. 10, or the drive shaft and rack of FIG. 11, a lever such as a joystick or other device may be provided that is operatively connected to the drive transmission 100 or 200 so that movement of the lever controls operation of the drive transmission, and hence movement of the hoist lines. Thus, the lever either controls the two drive shafts 104 and 106, or the drive shaft 204 and sliding rack 216. For example, pushing the lever forward would cause both drums to rotate clockwise at the same speed, and therefore pay both hoist lines out at the same rate. Pulling the lever back would cause both drums to rotate counterclockwise, and therefore pull in both hoist lines at the same rate. Pushing the lever to the left would cause the drums to rotate in opposite directions, thereby pulling in the rear hoist line and paying out the front hoist line. Pushing the lever to the right would have the opposite effect, causing the drums to pull in the front hoist line and pay out the rear hoist line. Accordingly, dumping would be accomplished by pushing the lever far to the left and paying out the front hoist line and pulling in the rear hoist at some predetermined ratio.

Moving the lever or joystick to intermediate positions would vary the direction and rate of rotation of the drums, and thus the movement of the hoist lines relative to one another. With the joystick controls for example, pushing the lever forward and to the left would pay both hoist lines out but hold the rear hoist line in more than the front hoist line. Likewise, pulling the lever to the back and to the left would pull in both hoist lines, but pull the rear hoist line in more than the front hoist line.

It is envisaged that such a lever control could be either mechanically or electrically connected to the drive transmission.

Raising, lowering and dumping of the bucket are accomplished by independently controlling the front hoist line and rear hoist line. For front dumping buckets, it is desired to control dumping so that the bucket rotates about a point that is located behind, or to the rear, of the loaded center of gravity. The location of the point about which the bucket rotates during dumping may be controlled by controlling the payout speed of the front hoist line and retrieval speed of the rear hoist line. In order to cause the bucket to rotate about a point behind the center of gravity of the bucket, the ratio of the speed at which the front hoist line is extended to the retrieval speed of the rear hoist line should be greater than or equal to the ratio of $D_F$ to $D_R$. Preferably, the ratio of the front hoist line payout speed to the rear hoist line retrieval speed should be from 1.2 to 1.4 times greater than the ratio of $D_F$ to $D_R$, and more preferably is about 1.3 times greater. This should provide a clean dumping action for the bucket. Of course, if the bucket is being dumped to the rear, then the relationships are reversed.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A dragline apparatus comprising:

(a) a front hoist winch and a front hoist line, a rear hoist winch and a rear hoist line, and a drag winch and a drag rope;

(b) a bucket having a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket, and at least one front hoist line connection point located adjacent to said forward end of said bucket;

(d) said rear hoist line connection point and said front hoist line connection point being operably connected to said rear hoist line and said front hoist line, respectively;

(e) said bucket having an average loaded center of gravity, located between said forward end and said rearward end of said bucket and spaced above said bottom wall, said rear hoist line connection point being located below said loaded center of gravity.

2. The apparatus of claim 1 wherein said bucket has an empty center of gravity, located between said forward end and said rearward end of said bucket and spaced above said bottom wall, said rear hoist line connection point being located below said empty center of gravity.

3. The apparatus of claim 1 wherein said front hoist line connection point is located nearer to said loaded center of gravity than is said rear hoist line connection point.

4. A dragline apparatus comprising:

(a) a front hoist winch and a front hoist line, a rear hoist winch and a rear hoist line, and a drag winch and a drag rope;

(b) a bucket having a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket, and at least one front hoist line connection point located adjacent to said forward end of said bucket;

(d) said rear hoist line connection point and said front hoist line connection point being operably connected to said rear hoist line and said front hoist line, respectively;

(e) said bucket having an average loaded center of gravity, located between said forward end and said rearward end of said bucket and spaced above said bottom wall, said front hoist line connection point being located nearer to said loaded center of gravity than is said rear hoist line connection point.

5. The apparatus of claim 4 wherein said bucket has an empty center of gravity, located between said forward end and said rearward end of said bucket and spaced above said bottom wall,-said front hoist line connection point being located nearer to said empty center of gravity than is said rear hoist line connection point.

6. A dragline apparatus comprising:

(a) a front hoist winch and a front hoist line, a rear hoist winch and a rear hoist line, and a drag winch and a drag rope;

(b) a bucket having a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket and connected to said rear hoist line, and a pair of transversely-spaced front hoist line connection points located adjacent to said forward end of said bucket and connected to said front hoist line;

(d) said front hoist line connection points being operably liftable by said front hoist line independently of tension in said rear hoist line;

(e) said front hoist line connection points being located near respective top edges of said sidewalls.

7. A dragline apparatus comprising:

(a) a front hoist winch and a front hoist line, a rear hoist winch and a rear hoist line, and a drag winch and a drag rope;

(b) a bucket having a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket, and at least one front hoist line connection point located adjacent to said forward end of said bucket;

(d) said front hoist line connection point being connected to, and operably liftable by, said front hoist line independently of tension in said drag rope;

(e) said bucket having an average loaded center of gravity, located between said forward end and said rearward end of said bucket and spaced above said bottom wall, said rear hoist line connection point being located below said loaded center of gravity.

8. The apparatus of claim 7 wherein said bucket has an empty center of gravity, located between said forward end and said rearward end of said bucket and spaced above said bottom wall, said rear hoist line connection point being located below said empty center of gravity.

9. The apparatus of claim 7 wherein said front hoist line connection point is located nearer to said loaded center of gravity than is said rear hoist line connection point.

10. A dragline apparatus comprising:

(a) a front hoist winch and a front hoist line, a rear hoist winch and a rear hoist line, and a drag winch and a drag rope;

(b) a bucket having a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket, and at least one front hoist line connection point located adjacent to said forward end of said bucket;

(d) said front hoist line connection point being connected to, and operably liftable by, said front hoist line independently of tension in said drag rope;

(e) said bucket having an average loaded center of gravity, located between said forward end and said rearward end of said bucket and spaced above said bottom wall, said front hoist line connection point being located nearer to said loaded center of gravity than is said rear hoist line connection point.

11. The apparatus of claim 10 wherein said bucket has an empty center of gravity, located between said forward end and said rearward end of said bucket and spaced above said bottom wall, said front hoist line connection point being located nearer to said empty center of gravity than is said rear hoist line connection point.

12. A dragline apparatus comprising:

(a) a front hoist winch and a front hoist line, a rear hoist winch and a rear hoist line, and a drag winch and a drag rope;

(b) a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket and connected to said rear hoist line, and a pair of transversely-spaced front hoist line connection points located adjacent to said forward end of said bucket and connected to said front hoist line;

(d) said front hoist line connection points being operably liftable by said front hoist line independently of tension in said drag rope;

(e) said front hoist line connection points being located near respective top edges of said sidewalls.

13. A dragline apparatus comprising:

(a) a front hoist winch and a front hoist line, a rear hoist winch and a rear hoist line, and a drag winch and a drag rope;

(b) a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket, and at least one front hoist line connection point located adjacent to said forward end of said bucket;

(d) said rear hoist line connection point and said front hoist line connection point being operably connected to said rear hoist line and said front hoist line, respectively;

(e) said bucket having a hitch assembly adjacent to said forward end of said bucket which includes both said drag rope connection point and said front hoist line connection point;

(f) said bucket having an average loaded center of gravity, located between said forward end and said rearward end of said bucket and spaced above said bottom wall, said rear hoist line connection point being located below said loaded center of gravity.

14. The apparatus of claim 13 wherein said bucket has an empty center of gravity, located between said forward end and said rearward end of said bucket and spaced above said bottom wall, said rear hoist line connection point being located below said empty center of gravity.

15. The apparatus of claim 13 wherein said bucket has a pair of transversely-spaced rear hoist line connection points located below said loaded center of gravity.

16. The apparatus of claim 15 including a pair of lines, transversely interconnected by a spreader bar, connected to said pair of transversely-spaced rear hoist line connection points.

17. A dragline apparatus comprising:

(a) a front hoist winch and a front hoist line, a rear hoist winch and a rear hoist line, and a drag winch and a drag rope;

(b) a pair of transversely-spaced sidewalls extending between a forward end and a rearward end of said bucket, said sidewalls being transversely interconnected by a bottom wall and a rear wall, said bottom wall terminating forwardly in a lip adapted to be equipped with excavating teeth, each of said sidewalls having a drag rope connection point adjacent to said forward end of said bucket;

(c) said bucket having at least one rear hoist line connection point located adjacent to said rearward end of said bucket, and at least one front hoist line connection point located adjacent to said forward end of said bucket;

(d) said rear hoist line connection point and said front hoist line connection point being operably connected to said rear hoist line and said front hoist line, respectively;

(e) said bucket having an average loaded center of gravity, located between said forward end and said rearward end of said bucket and spaced above said bottom wall, said rear hoist line connection point being located below said loaded center of gravity and said front hoist line connection point being located above said loaded center of gravity.

18. The apparatus of claim 17 wherein said bucket has an empty center of gravity, located between said forward end and said rearward end of said bucket and spaced above said bottom wall, said rear hoist line connection point being located below said empty center of gravity and said front hoist line connection point being located above said empty center of gravity.

19. The apparatus of any of claims 1, 4, 6, 7, 10, 12, 13 and 17 wherein said drag rope connection point is operably connected to said drag rope independently of any drag chain.

20. The apparatus of any of claims 1, 4, 6, 7, 10, 12, 13 and 17 wherein said respective rear hoist line and front hoist line connection points are operably connected to said rear hoist line and front hoist line, respectively, independently of any chain rigging.

21. The apparatus of any of claims 1, 4, 6, 7, 10, 12, 13 and 17 further including at least one wear protector detachably mounted on an exterior surface of said drag rope adjacent to said drag rope connection point.

22. The apparatus of any of claims 1, 4, 6, 7, 10, 12, 13 and 17 further including at least one wear protector detachably mounted on an exterior surface of at least one of said respective front and rear hoist lines.

23. The apparatus of any of claims 1, 4, 6, 7, 10, 12, 13 and 17 wherein said bottom wall merges with said rear wall so as to form a heel therebetween having minimal wear-resistant material thereon.

24. The apparatus of any of claims 1, 4, 6, 7, 10, 12, 13 and 17 having an arch transversely interconnecting said sidewalls adjacent to said forward end at a location above said sidewalls.

25. The apparatus of any of claims 1, 4, 6, 7, 10, 12, 13 and 17 free of any arch transversely interconnecting said sidewalls adjacent to said forward end at a location above said sidewalls.

26. The apparatus of any of claims 1, 4, 6, 7, 10, 12, 13 and 17 including a hollow tube transversely interconnecting said sidewalls at a location above said sidewalls.

27. The apparatus of any of claims 1, 4, 7, 10, 13 and 17 wherein said bucket has a pair of transversely-spaced hoist line connection points for at least one of said front hoist line and rear hoist line.

28. The apparatus of any of claims 1, 4, 7, 10, 13 and 17 wherein said rear hoist line connection point is located at a height vertically closer to said bottom wall than to said loaded center of gravity.

29. The apparatus of any of claims 1, 4, 7, 10, 13 and 17 wherein said front hoist line connection point and said loaded center of gravity define a first line, and said rear hoist line connection point and said loaded center of gravity define a second line, said first line and said second line defining an upwardly-facing included angle therebetween in a range from 130° to about 180°.

30. The apparatus of any one of claims 1, 4, 7, 10, 13 and 17 wherein said bucket has a pair of transversely-spaced front hoist line connection points connected to at least one said front hoist line.

31. The apparatus of claim 30 wherein said bucket has a pair of transversely-spaced rear hoist line connection points connected to at least one said rear hoist line.

32. The apparatus of any one of claims 1, 4, 7, 10, 13 and 17 wherein said bucket has a pair of transversely-spaced rear hoist line connection points connected to at least one said rear hoist line.

33. The apparatus of either one of said claims 6 and 12 wherein said bucket has a pair of transversely-spaced rear hoist line connection points connected to at least one said rear hoist line.

* * * * *